United States Patent [19]

Aoki

[11] 4,004,498

[45] Jan. 25, 1977

[54] HYDRAULIC MOTOR

[75] Inventor: Katashi Aoki, Sakaki, Japan

[73] Assignee: Nissei Plastics Industrial Co., Ltd., Sakaki, Japan

[22] Filed: Sept. 8, 1975

[21] Appl. No.: 611,113

Related U.S. Application Data

[63] Continuation-in-part of Ser. No. 441,919, Feb. 12, 1974, abandoned.

[52] U.S. Cl. ..... 91/476; 60/483; 91/413; 91/443; 91/491; 92/148

[51] Int. Cl.[2] ..... F01B 3/10

[58] Field of Search ..... 92/72, 148; 91/413, 91/36, 39, 480, 481, 491, 443, 411 R, 476; 60/483

[56] References Cited

UNITED STATES PATENTS

| | | | |
|---|---|---|---|
| 147,599 | 2/1874 | Brownell | 92/148 |
| 724,261 | 3/1903 | Cole | 91/481 |
| 2,974,637 | 3/1961 | Holmes | 91/443 |
| 3,075,504 | 1/1963 | Vogel | 91/39 |
| 3,266,436 | 8/1966 | Yarger | 60/483 |
| 3,314,364 | 4/1967 | Green | 91/481 |
| 3,379,099 | 4/1968 | Missioux | 91/36 |
| 3,396,633 | 8/1968 | Ryzner | 91/411 R |
| 3,558,102 | 1/1971 | Cruse | 91/447 |
| 3,610,106 | 10/1971 | Cavalieri | 92/72 |

*Primary Examiner*—Martin P. Schwadron
*Assistant Examiner*—Abraham Hershkovitz
*Attorney, Agent, or Firm*—David H. Semmes

[57] ABSTRACT

An intermittent hydraulic motor which comprises: a crank shaft; a plurality of hydraulic cylinders having pistons engaging with an eccentric member of said crank shaft; pressure oil lines connected to said hydraulic cylinders; check valves having choke valves; and independent changeover valves which connect one of said hydraulic cylinders to a pressure pump and the others to an oil tank; and being characterized in that said crank shaft together with said eccentric member is rotated independently of synchronism with the crank shaft for a certain angle only by the application of oil pressure to said one of the hydraulic cylinders.

6 Claims, 6 Drawing Figures

HYDRAULIC MOTOR

CROSS-REFERENCE TO RELATED APPLICATIONS

This application is a continuation-in-part of Ser. No. 441,919, filed Feb. 12, 1974, now abandoned.

BACKGROUND OF THE INVENTION

The invention relates to a hydraulic motor to intermittently rotate a crank shaft by means of a plurality of hydraulic cylinders. More particularly, the invention relates to a hydraulic motor which rotates a crank shaft smoothly and intermittently for very certain angles.

There have been several intermittent rotation mechanisms, such as the combination of a rack and pinion, the combination of hydraulic cylinders and connecting arms, and a direct connection to an oil motor. They involve many problems to be solved, among which the most desirable one is to moderate the shock of stopping. And for such purpose, slow-down valves are employed or some devices are incorporated to the hydraulic oil circuit. Any complete solution on this problem to eliminate the shock of stopping and absorb the inertia of rotation, however, has never been proposed. So that, complicated hydraulic circuits or expensive valves are used for this purpose.

In the meantime, there is known a radial piston-type hydraulic motor in which a plurality of hydraulic cylinders are provided on the radial directions in the casing, and the crank shaft is rotated by pistons in the cylinders and connecting rods contacted to the eccentric portion of the crank shaft. The hydraulic oil pressure is provided to said hydraulic cylinders in turn, thus continuous rotation is caused by the hydraulic oil pressure. In this type of hydraulic motor, changeover valves are provided in the oil passages to respective cylinders, and intake and discharge cycles in each cylinder are carried out in synchronism with the rotation of crank shaft. Accordingly, such an hydraulic motor can be rotated continuously at a certain speed by the action of hydraulic cylinders however, it is not possible to rotate the crank shaft intermittently for respective controlled angles. In distinction to such continuously rotating hydraulic motors requiring this synchronism with the crank shaft, the present invention employs externally operated changeover valve means selectively operable independent of such a synchronism.

BRIEF SUMMARY OF THE INVENTION

In view of the above facts, the principal object of the present invention is to provide an improved hydraulic motor which can be rotated intermittently for very certain angles.

A further object of the present invention is to provide a hydraulic motor which is able to drive for such respective controlled angles without causing the shocks of starting and stopping.

A further object of the present invention is to provide a hydraulic motor in which the pressure oil dicharged from the cylinders to oil lines during the rotation of crank shaft can be effectively controlled to give damping effect, thus the rotation of crank shaft with inertia can be successfully stopped at every desired angle.

Still further object of the present invention is to provide a hydraulic motor which can be rotated to any directions by operating the changeover valves in the oil circuit to hydraulic cylinders.

BRIEF DESCRIPTION OF THE DRAWINGS

These and other features of the present invention will be more fully understood by referring to the following detailed description presented solely for purpose of illustration and to the accompanying drawings in which.

DETAILED DESCRIPTION OF THE INVENTION

Figure 1:
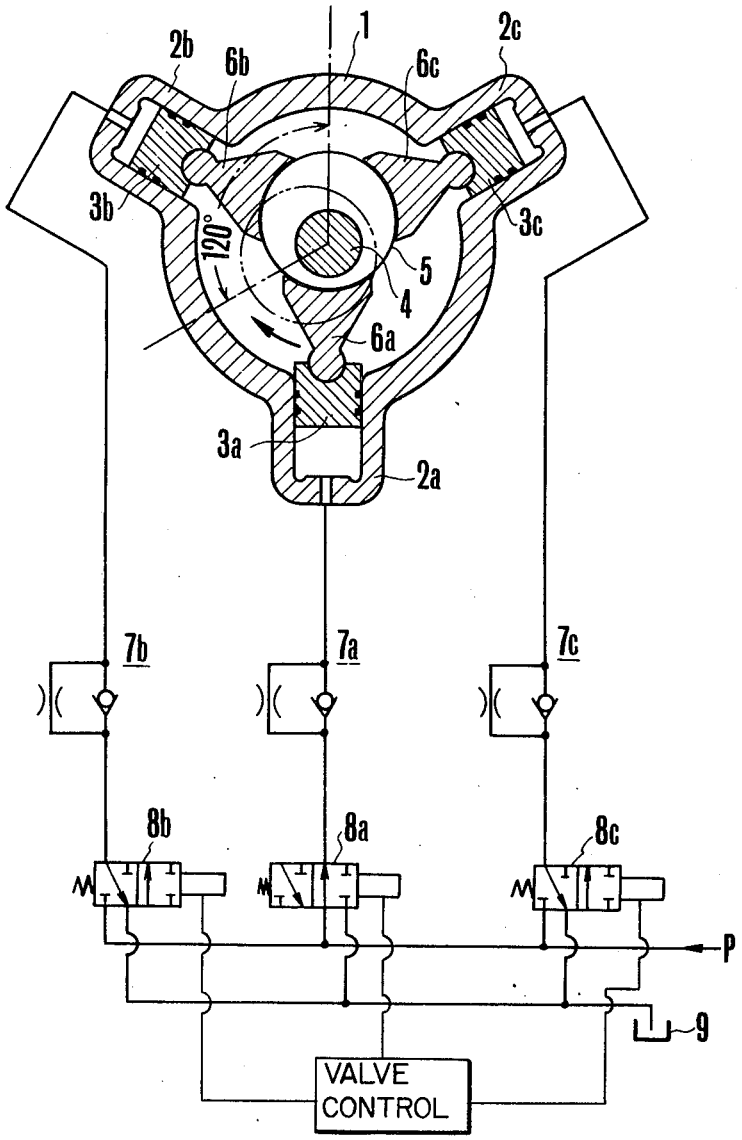
FIG. 1 is a schematic cross-sectional view of the first embodiment of the present invention.

Referring now to the drawings, especially to FIG. 1, similarly to the conventional radial piston-type hydraulic motors, the hydraulic motor of the present invention is provided with three hydraulic cylinders 2*a*, 2*b*, and 2*c* on radial directions in a casing 1; three pistons 3*a*, 3*b* and 3*c* in said respective cylinders 2*a*, 2*b* and 2*c*; an eccentric plate 5 on a crank shaft 4 at the center of said casing 1; and three connecting rods 6*a*, 6*b* and 6*c* disposed around said eccentric plate 5.

The pressure oil lines connected to said hydraulic cylinders 2*a*, 2*b* and 2*c* in the casing 1 at every 120° interval are provided with flow control-type check valves 7*a*, 7*b* and 7*c*, and changeover valves 8*a*, 8*b* and 8*c*. The charge and discharge of pressure oil to said hydraulic cylinders 2*a*, 2*b* and 2*c* are carried out by way of these changeover valves, and the rotation of the crank shaft 4 which being made integrally with said eccentric plate 5, is caused such that one of hydraulic cylinders is connected to a pump P, and at the same time, the other two cylinders are connected to a tank 9 to reduce the pressure. A conventional valve control operable to selectively connect, for example, changeover valve 8*a* to the pressure source of oil while venting valves 8*b* and 8*c* is shown at FIG. 1. The valve control may be a simple three position switch which will selectively energize any one of the valve solenoids for valves 8*a–c* while leaving the other two in a normally closed position.

In FIG. 1, the hydraulic cylinders 2*b* and 2*c* are connected to the tank 9 to reduce the hydraulic oil pressure, and the hydraulic cylinder 2*a* is connected to the pump P to receive the hydraulic oil pressure, thus the eccentric plate 5 has been pushed by the piston 3*a* through the connecting rod 6*a*. Just after the changes of the valves to the positions as shown in FIG. 1, the eccentric plate 5 is positioned as shown by the circle of chain line, in such state, the connecting rod 6*a* of the cylinder 2*a* is positioned in like manner as the connecting rod 6*c* in FIG. 1. Then, as the pressure in the cylinder 2*a* being increased the connecting rod 6*a* is pushed forward to rotate the eccentric plate 5 for 120° in the direction as shown by an arrow. At the same time, as pressure oil lines from the cylinders 2*b* and 2*c* are connected to the tank 9, the pressure oil in the cylinder 2*c* is discharged, while the pressure oil in the cylinder 2*b* is initially discharged and then sucked in during the latter half of the 120° rotation, because the distance from the center of rotation to the surface of the eccentric plate 5 at the position of the cylinder 2b is increased in the initial half of the rotation, and said distance is decreased in the latter half of the 120° rotation. While the flow of the pressure oil in the oil lines may be controlled by the valves 7b and 7c, each of said valves as illustrated and herein described being a combined valve means. Each of 7a, 7b and 7c comprises a check valve, operable to allow oil from the changeover valve to flow only towards the respective cylinders, in parallel flow relation to a choke valve which, as hereinafter is explained, meters the reverse flow of oil from the cylinder to the respective changeover valves. The resistance of the movement is gradually increased as the connecting rod 6c comes near to the upper dead center of the eccentric plate 5, and the effect of rotation by the connecting rod 6a is gradually decreased as the rod 6a comes near to the lower dead center of the eccentric plate 5, accordingly a damping effect is caused to resist the inertia of the eccentric plate 5 and the rotation for 120° can be effectively stopped when the connecting rod 6a goes to the foremost position as shown by the solid lines in FIG. 1.

Accordingly, the rotation of the crank shaft 4 (being integral with the eccentric plate 5) is always 120°, and the deviation of the rotation is very little. When similar operations are continued in turn by changing the changeover valves 8a, 8b and 8c, the eccentric plate 5 together with the crank shaft 4 is intermittently rotated each for 120°.

Further, in the state as shown in FIG. 1, when the eccentric plate 5 is pushed by the connecting rod 6b, the crank shaft 4 may be rotated in the clockwise direction, and to the contrary, when the eccentric plate 5 is pushed by the connecting rod 6c, the crank shaft 4 may be rotated in the counterclockwise direction. This means that the direction of the rotation can be controlled only by the operation of the changeover valves 8a, 8b and 8c, accordingly, if the operations of the changeover valves are electrically controlled according to the conventional art, any complicated intermittent rotation can be practiced. Unlike prior art hydraulic motors set up for continuous operation, herein the intermittent motion results from the selective energization of only one of the two position valves 8a–c, and any energized valve is immediately opened without any synchronization to the rotation of the crank shaft.

Figure 2:
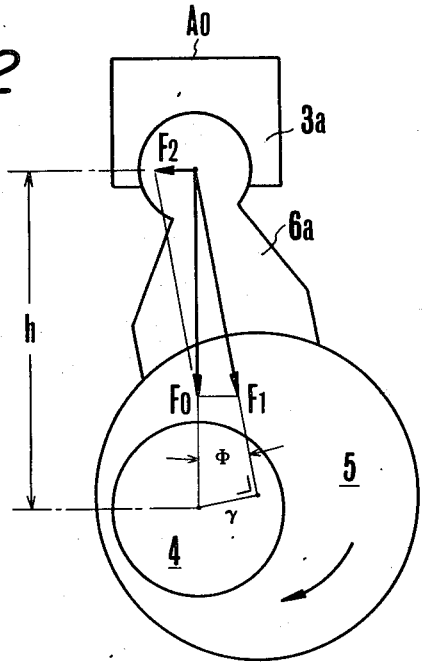
FIG. 2 is a schematic illustration for the explanation of driving torque.

In the following the force of rotation by the driving piston will be calculated according to FIG. 2.

The force of piston 3a is calculated as:

$$F_o = A_o\, p$$

where $F_o$ = force of piston 3a, $A_o$ = cross-sectional area of the piston 3a, and $p$ = pressure of the hydraulic oil. The force $F_o$ is divided to components $F_1$ and $F_2$, in which the force $F_1$ is directed to the center of eccentric plate, and the force $F_2$ is vertical to the wall of cylinder. Each $F_1$ and $F_2$ may be represented as follows.

$$F_1 = \frac{F_0}{\cos\phi}$$
$$F_2 = F_0 \cdot \tan\phi$$

where $\phi$ is the angle between the line from the point of action of connecting rod 6a to the center of eccentric plate 5 and the line from the point of action of connecting rod 6a to the center of rotation. The torque of rotation may be represented by the product of the component force $F_1$ and the distance $r$ between the center of rotation and the extented line of said force $F_1$. Thus the torque (T) is:

$$T = F_1 \times r = \frac{F_0}{\cos\phi} \times h \cdot \sin\phi = F_0 \cdot h \cdot \frac{\sin\phi}{\text{sos}\phi} = F_0 \cdot h \cdot \tan\phi$$

where $h$ is the distance from the point of action of connecting rod 6a to the center of rotation. According to the above formula, the torque T converges to zero when the connecting rod 6a approaches the lower dead center of the eccentric plate 5, because the angle $\phi$ as well as tan $\phi$ becomes zero.

In practice, the total torque of rotation may be effected by not only this driving force but also the damping action of other two cylinders and mechanical frictions. Then, the hydraulic motor as shown in FIG. 1 was operated from the position of the chain line to the solid line in said figure, and the driving torque of the cylinder 2a and the damping torque of the cylinder 2c were measured, the results of which are shown in the accompanying drawing, FIG. 3. In this test, the major factors were as follows:

| | |
|---|---|
| Vacuum pump: | 140 Kg/cm², 30 liter/min. |
| Piston (3): | 50 mm in diameter |
| Eccentric plate: | 900 mm in diameter |

Figure 3:
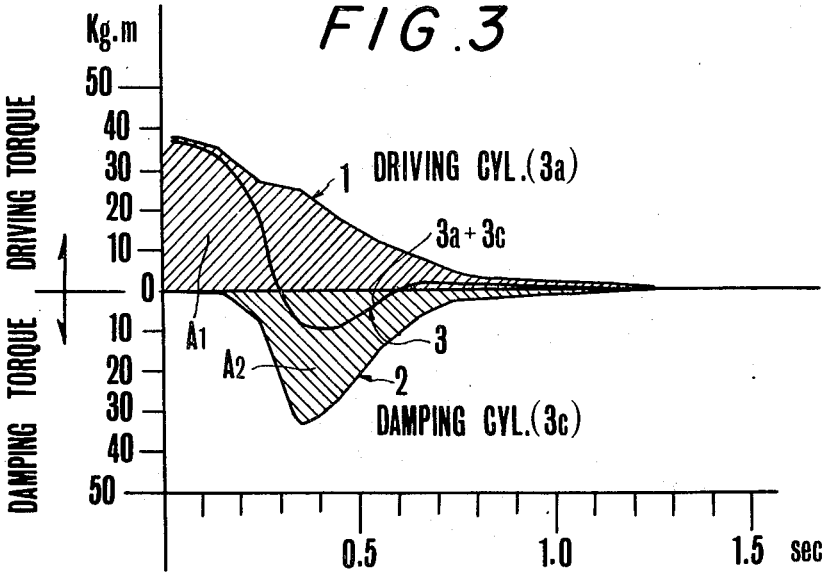
FIG. 3 is a graphical representation of the driving torque and damping torque.

It will be understood from the diagram in FIG. 3 that the driving torque of the cylinder 2a decreases gradually as the damping torque of the cylinder 2c is generated. This damping torque is caused by the resistance of flow of the hydraulic oil through the choke-type check valve 7c, and owing to this effect, the braking force is imparted in the latter half of the rotation as shown by the line of combined force of the driving torque and damping torque in FIG. 3.

Figure 4:
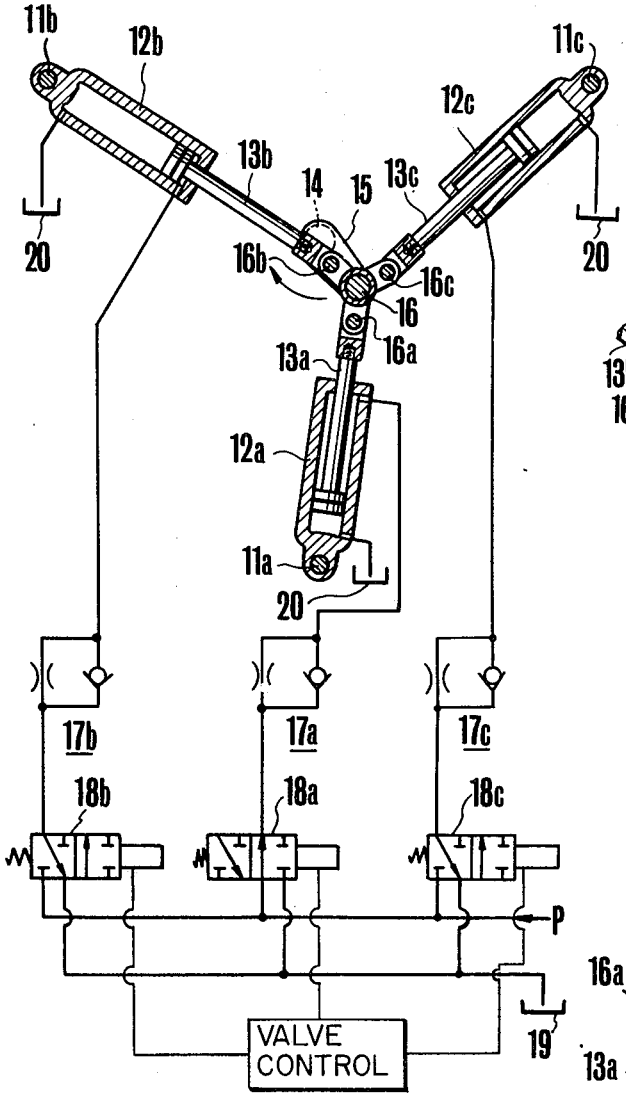
FIG. 4 is a cross-sectional view of the second embodiment of the invention.

In another embodiment as shown in FIG. 4, there are provided three cylinders 12a, 12b and 12c which are swingably supported by pins 11a, 11b and 11c, respectively. The pistons 13a, 13b and 13c of said cylinders are connected to a crank arm 15 of a crank shaft 14 by means of a crank pin member 16. That is, the crank pin member 16 is provided with three pins 16a, 16b and 16c at 120° intervals, and the tips of said pistons are pivoted to these pins. In like manner as the foregoing embodiment in FIG. 1, respective cylinders 12a, 12b and 12c are provided with pressure oil lines having check valves with chokes 17a, 17b and 17c and changeover valves 18a, 18b and 18c, in addition to that, the cylinders are further provided with oil discharge lines which are connected to holding tanks 20.

Figure 5:
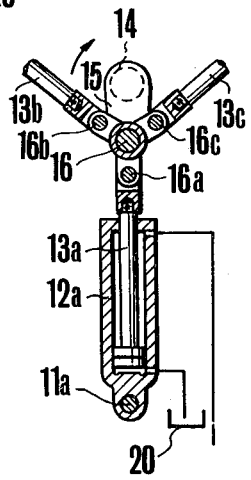
FIG. 5 is a fragmentary cross-sectional view of the portion of one hydraulic cylinder of the second embodiment.
Figure 6:
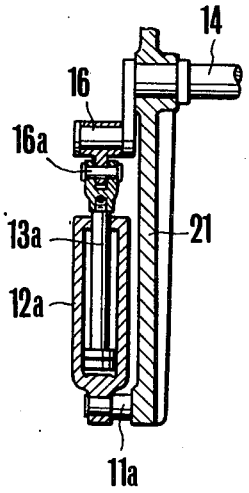
FIG. 6 is a cross-sectional view showing the attachment of the crank shaft and a hydraulic cylinder.

In this embodiment, for example, the cylinder 12a is connected to the pump P by the operation of the changeover valves 18a, 18b and 18c, in the meantime, other two cylinders 12b and 12c are connected to the tank 19 to release the resistance of the pressure oil. Thus, the piston 13a pulls the crank pin member 16a by the force of pressure oil fed into the cylinder 12a through the check valve 17a, and the crank shaft 14 is rotated for 120° to the direction of the arrow together with the rotation of the crank arm 15 and with the swing motion of the cylinder 12a. Along with this rotation, the pistons 13*b* and 13*c* of the cylinder 12*b* and 12*c* discharge the pressure oil through the choke valves 17*b* and 17*c* to the tank 19, while in like manner as the foregoing embodiment, the pressure oil of the cylinder 12*b* is initially discharged and then sucked in the latter half of the 120° rotation. Thus, the rotation of the crank shaft 14 can be effectively braked by such resistances of the oil flow from the hydraulic cylinders 12*b* and 12*c*, and the crank shaft 14 is rotated just for 120°. FIG. 5 shows the positions of the hydraulic cylinder 12*a*, the crank arm 15 and the crank pin member 16 where the piston 13*a* is at the lower dead center after the completion of the 120° rotation. As shown in FIG. 6, each cylinder 12*a*, 12*b* or 12*c* and the crank shaft 14 may be attached to a base plate 21.

As seen from the above disclosure, the hydraulic motor according to the present illustrated embodiments of the present invention can rotate the parts which are attached to the crank shaft for intermittent 120° rotations and the normal and reverse rotations can be easily carried out only by operating the changeover valves through the valve control. Further, in the second embodiment, the crank shaft 14 is rotated by pulling force of the pistons 13*a*, 13*b* and 13*c*, however, if the pressure oil lines having the changeover valves and check valves are connected to the other sides of the hydraulic cylinders, the crank shaft may be driven by the pushing force of the pistons in like manner as the first embodiment.

Further, the intermittent rotation angle is constant in the foregoing example, however, the rotation angle can be selected freely according to the practical purpose. And the direction of rotation can also be selected easily, and the structure of the system is simple and troublesome maintenance work is not necessary, therefore the hydraulic motor of the present invention can be used for a wide variety of purposes.

It should be emphasized, however, that the specific embodiments described and shown herein are intended as merely illustrative and in no way restrictive of the invention.

I claim:

1. A hydraulic motor for intermittently rotating a crank shaft through a certain angle only which comprises a crank shaft; a plurality of hydraulic cylinders having respective pistons which are disposed in radial directions from said crank shaft at regular angular intervals, said pistons being engaged with an eccentric member means formed integrally with said crank shaft; a pressure source of oil with separate oil line means connected to each of said hydraulic cylinders; combined check and choke valve means in each of said separate oil line means wherein each combined valve means comprises a check valve operable to allow said oil from said pressure source of oil to flow in said each separate oil line means towards said each cylinder, said each combined valve means further comprising a choke valve in parallel flow relation to said check valve so as to control the flow of discharged oil in each separate oil line means from said each hydraulic cylinder; wherein said each separate oil line means further comprises an externally operated changeover valve means between said each combined check and choke valve means and said pressure source of oil, means for selectively energizing said externally operated changeover valve means to selectively connect, independently of synchronism with said crank shaft, only one of said hydraulic cylinders to said pressure source of oil while venting the oil lines from said other cylinders to an oil tank; and being characterized in that said selective connection of oil pressure to said one cylinder causes said crank shaft together with said eccentric member to selectively rotate for said certain angle only.

2. A hydraulic motor as claimed in claim 1, in which said eccentric member means comprises an eccentric plate.

3. An hydraulic motor as claimed in claim 1, in which said plurality of hydraulic cylinders is three, said regular angular intervals are each 120° and said certain angle of rotation is 120°.

4. An hydraulic motor as claimed in claim 1 wherein said pressure source of oil comprises a pressure pump.

5. An hydraulic motor as claimed in claim 1 wherein said changeover valves means are normally closed two-position solenoid valves, said means for selectively energizing comprising an electrical switching means operable to selectively actuate any one of said solenoids.

6. An hydraulic motor as claimed in claim 1 wherein said eccentric member means comprises a crank arm in combination with a crank pin member.

* * * * *